United States Patent [19]

Zuber

[11] Patent Number: 4,710,880

[45] Date of Patent: Dec. 1, 1987

[54] VEHICLE SPEED CONTROL APPARATUS AND METHOD

[75] Inventor: Pierre A. Zuber, Baldwin, Pa.

[73] Assignee: Westinghouse Electric Corp., Pittsburgh, Pa.

[21] Appl. No.: 675,675

[22] Filed: Nov. 28, 1984

[51] Int. Cl.[4] ..... G06F 11/16; B61L 3/20

[52] U.S. Cl. ..... 364/426; 371/67; 371/68; 246/182 R; 246/182 C

[58] Field of Search ..... 364/426, 436, 424, 183, 364/440; 246/182 R:182 B, 182 C, 187 B; 371/67, 68

[56] References Cited

U.S. PATENT DOCUMENTS

| | | | |
|---|---|---|---|
| 3,749,994 | 7/1973 | Matty | 318/563 |
| 3,783,339 | 1/1974 | Matty | 318/683 X |
| 4,015,082 | 3/1977 | Matty et al. | 178/66 R |
| 4,209,828 | 6/1980 | Anderson et al. | 364/426 |
| 4,217,643 | 8/1980 | Anderson et al. | 364/426 |
| 4,558,415 | 12/1985 | Zuber et al. | 364/426 |

*Primary Examiner*—Errol A. Krass
*Assistant Examiner*—Thomas G. Black
*Attorney, Agent, or Firm*—E. F. Possessky

[57] ABSTRACT

A passenger vehicle is provided for movement along a track having an input speed command including ONE and ZERO information components to control the vehicle speed. A first control apparatus including at least a first microprocessor is responsive to the ONE and ZERO information components for providing first and second speed error signals. A second control apparatus including at least a second microprocessor is responsive to the ONE and ZERO information components for providing third and fourth speed error signals the first control apparatus compares the first, second, third and fourth speed error signals for controlling the vehicle and the second control apparatus compares the first, second, third and fourth speed error signals for controlling the vehicle.

4 Claims, 11 Drawing Figures

TRACK SIGNAL A
4A
3A
3B
TACH PROCESSING
TACH PROCESSING
SPEED DECODING
SPEED ERROR 1
SPEED ERROR 2
DATA COLLECTOR 1
DATA COLLECTOR 2
DATA INTEGRITY CHECKER 1
DATA INTEGRITY CHECKER 2
SERIAL LINK INTERFACE
SERIAL LINK 1
SERIAL LINK 2
BUS 1
UOE 1
306
600
602
604
606
608
610
612
614
616
618
620
622
624
626
628
630
632
634
636
638
640
642
644
646
648
680
682

TACH PROCESSING
4A
SPEED ERROR 2
DATA COLLECTOR 2
DATA INTEGRITY CHECKER 2
649
UOE 3
696
BRAKE SYSTEM CONTROLLER
703
706
BUS 3
674
500
670
TRACK SIGNAL B
SPEED DECODING
641
DATA COLLECTOR 1
DATA INTEGRITY CHECKER 1
SPEED ERROR 1
637
3B
TACH PROCESSING
SERIAL LINK INTERFACE
3A

VEHICLE SPEED CONTROL APPARATUS AND METHOD

CROSS-REFERENCE TO RELATED APPLICATIONS

The present application is related to previously filed patent applications Ser. No. 496,693, now U.S. Pat. No. 4,558,415, filed May 5, 1983 by P. A. Zuber et al. and entitled "Vehicle Speed Control Apparatus and Method", and Ser. No. 609,253, now U.S. Pat. No. 4,625,275, filed May 11, 1984 by P. A. Zuber et al. and entitled "Vehicle Speed Control Apparatus and Method", and which are assigned to the same assignee as the present application; the disclosure of which is incorporated herein by reference.

BACKGROUND OF THE INVENTION

1. Field of the Invention:

The present invention relates to the speed control of passenger vehicles, such as mass transit vehicles or the like, and including the decoding of wayside-provided speed codes for vehicle speed control and speed maintenance purposes while the vehicle is moving along a roadway track.

2. Description of the Prior Art:

It is known in the prior art to provide a checked redundancy speed error determination as disclosed in U.S. Pat. No. 3,749,994 of T. C. Matty. It is also known in the prior art to individually decode the ones data and the zeros data of an input speed command from the roadway track, and then to compare the ones data with the zeros data to detect any discrepancy as disclosed in U.S. Pat. No. 4,015,082 of T. C. Matty et al.

A signal is provided for each pair of channels, which determines the operation of the propulsion and brake controller and in addition is fed back to the integrity check operations of the other pairs of channels. An underspeed operation enable signal is provided by each pair of channels to determine the operation of the propulsion and brake controller, and in addition is fed back to the integrity check operation of the other pairs of channels.

A general description of the microprocessors and the related peripheral devices as shown in FIG. 4 of the drawings is provided in the Intel Component Data Catalog currently available from Intel Corporation, Santa Clara, Calif. 95051.

SUMMARY OF THE INVENTION

An improved passenger vehicle speed control apparatus and method are provided for a vehicle operative with a track providing an input speed command including ONEs and ZEROs information components. The speed command decoding is provided in relation to both of the ONEs and the ZEROs information. A plurality of independent pairs of speed control channels respectively perform the speed error determination operation in relation to the ONEs and ZEROs information components of the input speed command. A data integrity check is performed in relation to the speed decoding operation of each pair of channels and of the other pairs of channels. An output toggle enable signal is provided for each pair of channels, which determines the operation of the propulsion and brake controller and in addition is fed back to the integrity check operations of the other pairs of channels. An underspeed operation enable signal is provided by each pair of channels to determine the operation of the propulsion and brake controller, and in addition is fed back to the integrity check operation of the other pairs of channels.

DESCRIPTION OF A PREFERRED EMBODIMENT

It is known to control a passenger vehicle moving along a roadway track with binary coded speed command signals received from the track, and which signals include binary logic ONEs and ZEROs information represented by multiple message frequencies. This information is decoded such that extraneous noise signals will not cause the vehicle to operate in an unsafe manner, such as disclosed in U.S. Pat. No. 4,015,082 of T. C. Matty et al.

It is known in rapid transit control systems to encode and transmit the speed code information to the vehicle by modulating one or more carrier frequencies, such as by providing one of the four frequency pairs listed in the following TABLE ONE to carry the speed command to the vehicle.

TABLE 1

| Frequency Pair | Logical level "1" | Logical level "0" |
|---|---|---|
| A | 5184 Hz | 7776 Hz |
| F | 5600 Hz | 8400 Hz |
| B | 5842 Hz | 8764 Hz |
| C | 6624 Hz | 9936 Hz |

The speed command can be encoded into a multiple bit comma-free code which is then transmitted to the vehicle using frequency shift key/phase shift key modulation with an 18 Hz data rate. In each frequency pair, the lower frequency can correspond to the logical level "1" while the higher frequency can correspond to the logical level "0". On board the vehicle, filters are required to filter out these carriers in order to recover the speed code information. It is known to provide the desired safety of the system through the integrity of reception, using crystal or mechanical filters, which filters exhibit a failsafe gain in addition to their high selectivity and stability.

Figure 1:
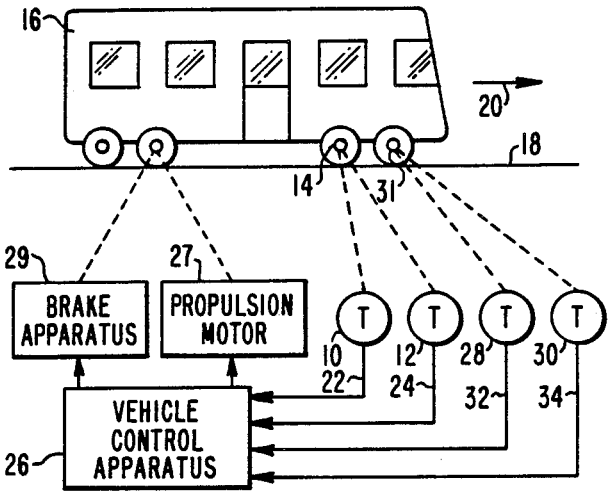
FIG. 1 PRIOR ART
FIG. 1 shows a prior art vehicle control apparatus for a passenger vehicle.

In FIG. 1 there is shown a prior art passenger vehicle control apparatus such as disclosed in U.S. Pat. No. 3,783,339, and including first and second tachometers 10 and 12 coupled with a first axle 14 of a vehicle 16 operative with a roadway track 18. The tachometers 10 and 12 are aligned relative to one another in a predetermined relationship such that if the vehicle is traveling in a forward direction as indicated by arrow 20, an output 22 signal is provided from the tachometer 10 which is displaced in a first phase relationship with the output signal 24 from the tachometer 12. In the event the vehicle is traveling in a reverse direction, the output signals appearing at the leads 22 and 24 are displaced from one another in a different and second phase relationship. In this way, the vehicle control apparatus 26 can provide a desired operation of the propulsion motor 27 or the brake apparatus 29 in response to the determined movement direction of the vehicle 16 by the relative phase displacement relationship of the signals 22 and 24. Similarly, the tachometers 28 and 30 coupled with a second axle 31 provide output signals 32 and 34 which have a first phase relationship when the vehicle is moving forward in the direction of the arrow 20 and a second and different phase relationship when the vehicle 16 is moving in the reverse direction.

Figure 2:
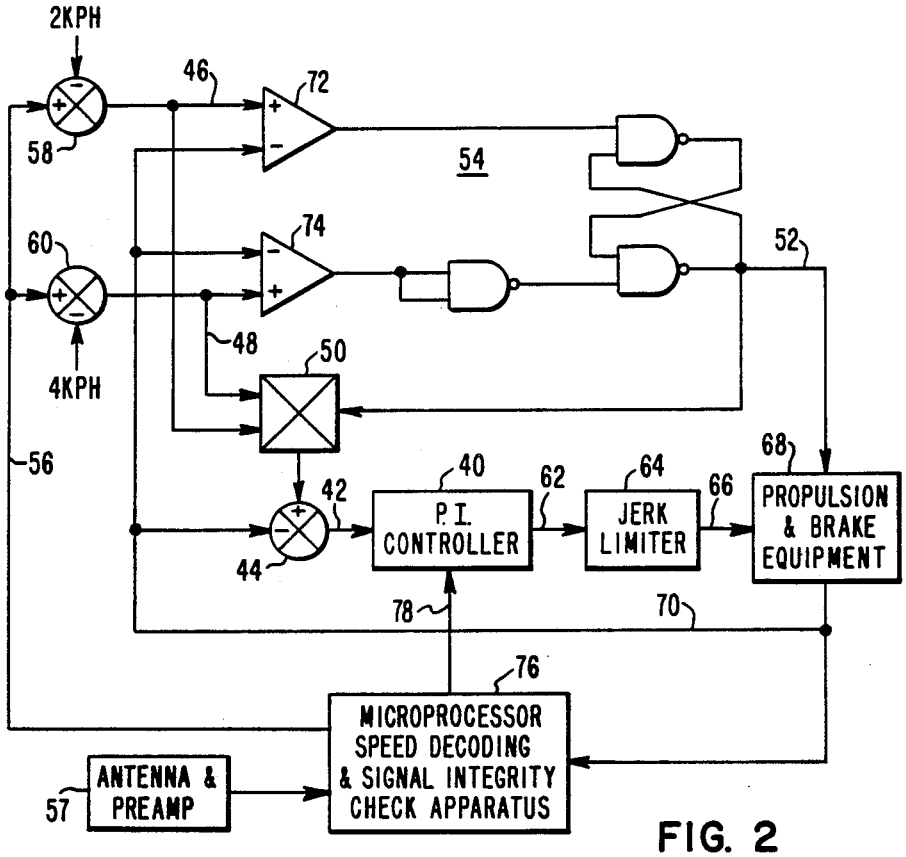
FIG. 2 PRIOR ART
FIG. 2 shows a prior art speed decoding apparatus.

In FIG. 2 there is provided a functional schematic of a prior art speed decoding and signal integrity check apparatus operative to enable the effort request signal generator in a vehicle speed maintaining control apparatus, such as disclosed in U.S. Pat. No. 4,217,643 of L. W. Anderson et al. A proportional plus integral controller 40 responds to a speed error signal 42 from a comparator 44 responsive to a speed feedback signal 70 and one of a brake reference velocity signal 46 or a power reference velocity signal 48, through operation of a selector 50 that responds to the brake mode or the power mode output control signal 52 of a power and brake controller 54. A decoded input speed command signal 56 is supplied to a first comparator 58 to provide the brake reference velocity signal 46 that is 2 KPH below the value of the speed command signal 56, and is operative with a comparator 60 to provide the power reference velocity signal 48 that is 4 KPH below the speed command signal 56.

The PI controller 40 provides an output first tractive effort request P signal 62 to a jerk limiter 64, which provides an output second effort request P signal 66 to the propulsion and brake equipment 68 of a transit vehicle. The output signal 52 from the power and brake controller 54 is either a brake mode control signal having a zero value or a power mode control signal having a one value. The actual speed 70 of the vehicle is fed back as an input to the power and brake controller 54. When the actual speed 70 is above the brake reference velocity signal 46, the comparator 72 causes the power and brake controller 54 to provide the brake mode control signal 52 to the propulsion and brake equipment 68. When the actual speed signal 70 is less than the power reference velocity signal 48, the comparator 74 causes the power and brake controller 54 to provide the power mode control signal 52 to the propulsion and brake equipment 68.

The programmed microprocessor speed decoding and signal integrity check apparatus 76 is in accordance with the disclosure of U.S. Pat. No. 4,209,828 of L. W. Anderson et al., the disclosure of which is incorporated herein by reference, and which compares the decoded input speed command signal 56 from the track signal antenna and preamp 57 with the vehicle actual speed signal 70 to provide an enable signal 78 to the PI controller 40 to enable the provision of the effort request signal 62 when the zeros data speed error signal, determined in accordance with the zeros data of the input speed command 56, is substantially the same as the ones data speed error signal.

Figure 3:
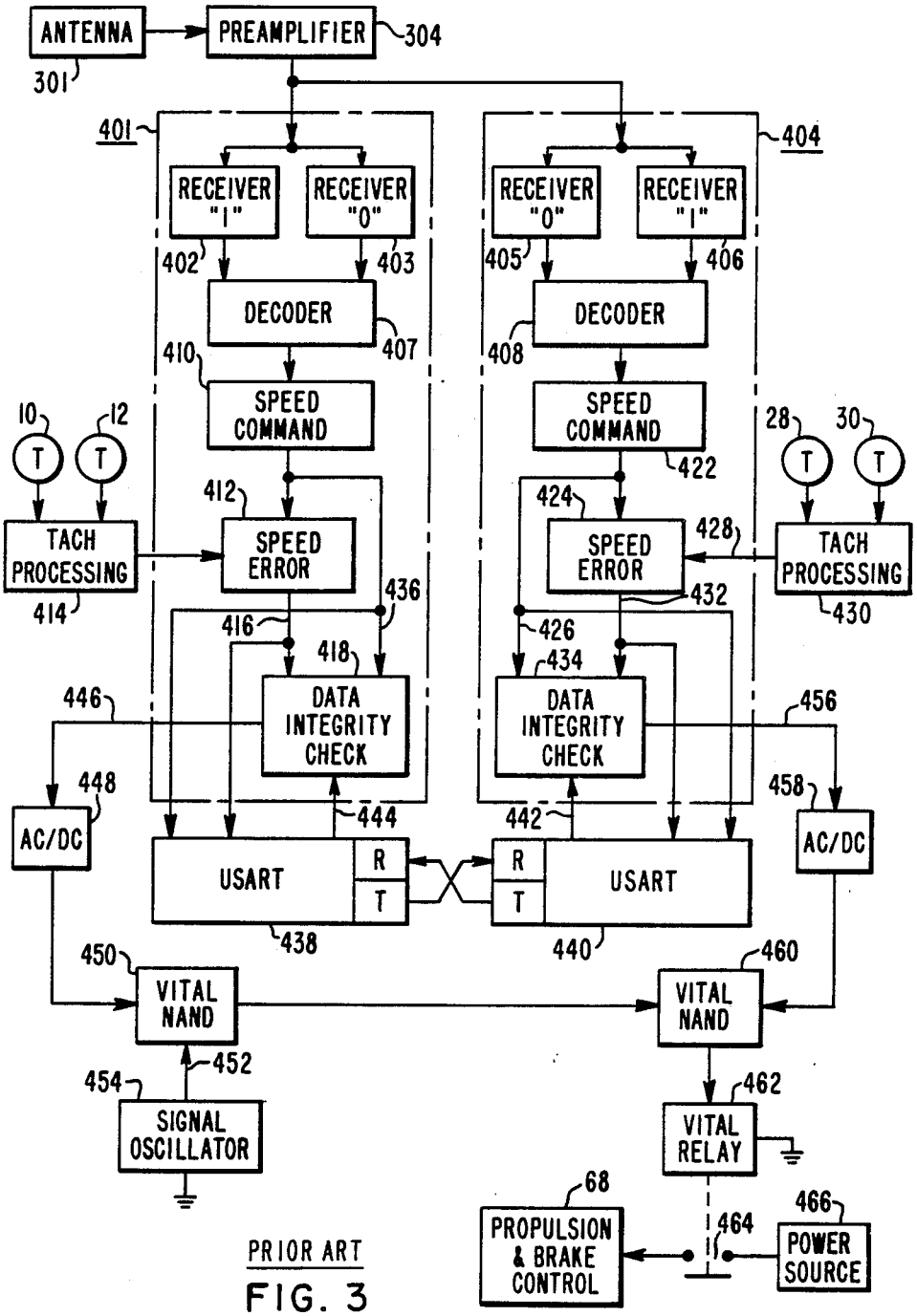
PRIOR ART FIG. 3
FIG. 3 shows a functional block diagram of a prior art speed decoding apparatus.

In FIG. 3 there is shown a functional block diagram to illustrate the sequential operations of the prior art speed control apparatus disclosed in the above-referenced patent application Ser. No. 609,253. The vehicle-carried antenna 301 senses the input speed command signal from the roadway track, and the signal strength is increased in a preamplifier 304. The signal then passes to a first microprocessor channel 401 including a receiver 402 tuned to the ONES data component of the input speed command signal, and a receiver 403 tuned to the ZEROS data component of the input speed command signal. A decoder 407 within the first microprocessor channel 401 operates to provide the speed command bias in relation to the ONES data from the receiver 402 and the ZEROs data from the receiver 403. At block 410 the speed command for the first microprocessor channel 401 is determined. A speed error determination apparatus 412 compares the speed command 436 with the vehicle speed from the tachometers 10 and 12 which pass through a well-known tachometer processing apparatus 414, to provide the vehicle speed error 416. The speed error 416 and the speed command 436 are supplied to a data integrity check apparatus 418 for the microprocessor channel 401.

A second microprocessor channel 404 includes a receiver 405 tuned to the ZEROS data component and a receiver 406 tuned to the ONES data component of the input speed command signal. The ZEROs data signal from the receiver 405 and the ONEs data signal from the receiver 406 operate with the decoder 408 to provide the speed command bias for the second microprocessor channel 404 to the decoder 408. At block 422 the speed command for the second microprocessor channel 404 is determined. A speed error determining apparatus 424 compares the speed command 426 with the vehicle speed 428 from a tachometer processing apparatus 430 operative with the tachometers 28 and 30 such as shown in FIG. 1. The speed error signal 432 and the speed command 426 are supplied to a data integrity check apparatus 434 for the data microprocessor channel 404.

The speed command signal 436 and the speed error 416 for the first microprocessor channel 401 are supplied to a well-known USART apparatus 438 operative with the microprocessor channel 401 to transmit each of the speed command 436 and the speed error 416 to a similar USART communication interface 440 operative with the microprocessor channel 404. The speed error 416 and speed command signal 436 are supplied through output 442 to the data integrity check apparatus 434 of the microprocessor channel 404. Similarly, the speed command 426 and the speed error 432 are transmitted by the USART 440 to the USART 438 and are provided through output 444 to the data integrity check apparatus 418 for the microprocessor channel 401. The programmable communication interface serial link apparatus 438 and 440 can include an Intel 8251A programmable data communication apparatus and related equipment, such as is described in the Intel Component Data Catalog from the Intel Corporation, Santa Clara, Calif. 95051. It takes a finite time for this serial transmission to occur, so a balance timer delay of about 250 milliseconds is provided for the operation of the data integrity checks 418 and 434.

After the balance time delay, if the speed command 436 and the speed command 426 in data integrity check 418 compare and are substantially the same, and if the speed error 416 and the speed error 432 in the data integrity check apparatus 418 compare within a predetermined difference such as 5KPH, then an output toggle signal 446 having a predetermined frequency, such as 9 hertz, is supplied through an AC to DC converter 448 to enable a vital NAND circuit 450 to pass a predetermined control signal 452 from a signal generator 454. This control signal 452 can have a predetermined frequency such as 159 kilo hertz modulated by 109 hertz. Similarly, after the balance time delay, if the speed command 426 compares and is substantially the same as the speed command 436 in the data integrity check 434 and if the speed error 432 compares within a predetermined difference such as 5KPH with the speed error 416 in the data integrity check 434, then an output toggle signal 456 having a predetermined frequency such as 9 hertz, is provided through an AC to DC converter 458 to enable a vital NAND circuit 460 to pass the signal from the vital NAND circuit 450. If each of the vital NANDS 450 and 460 are enabled in this manner to pass the signal 452, this will energize the vital relay 462 including a relay driver to close a contact 464 for energizing the propulsion and brake control 68 from the power source 466 for operation with the input speed command 56.

Figure 4A:
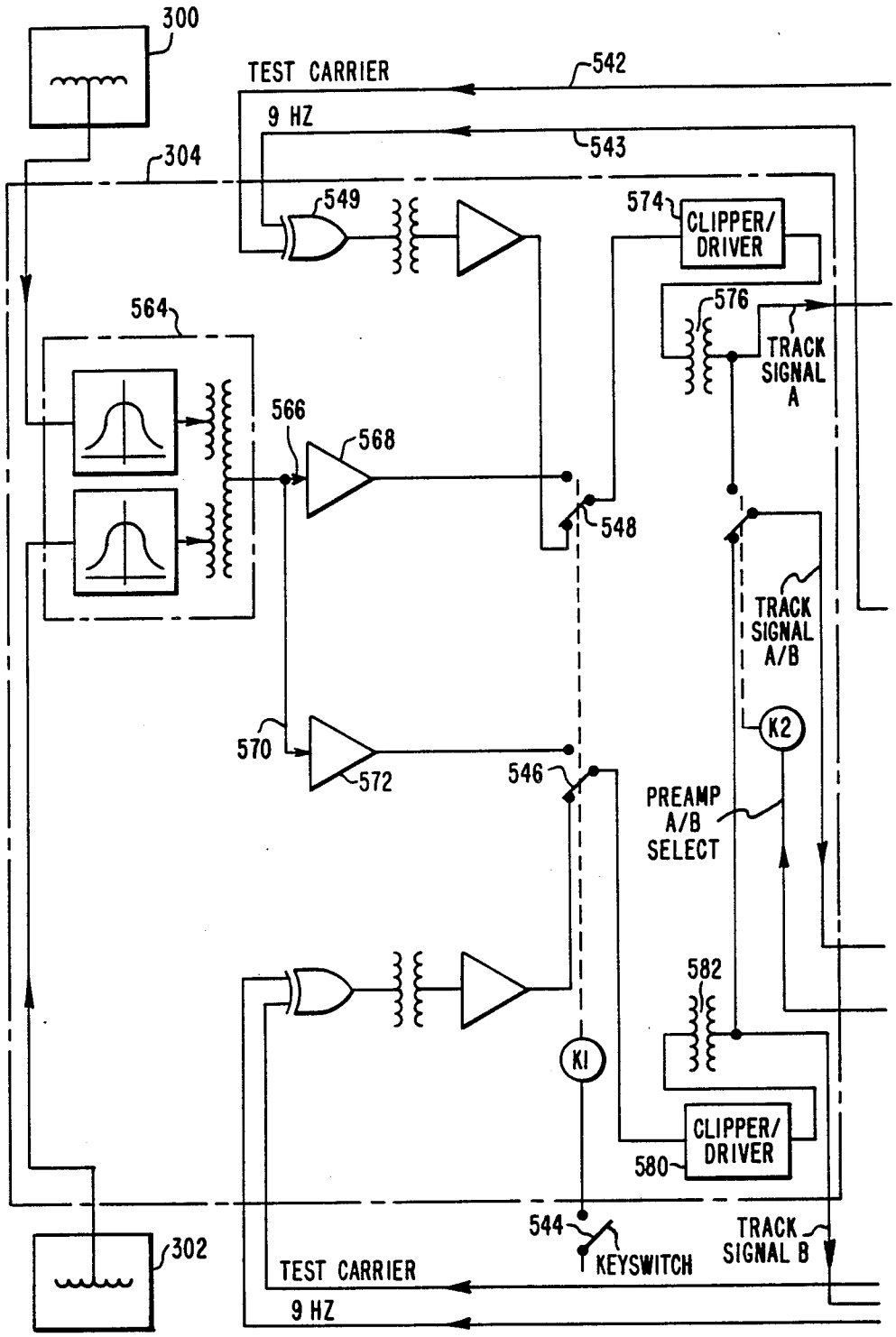
FIG. 4A PRIOR ART
FIGS. 4A-4B show a schematic block diagram of a prior art speed control apparatus.
Figure 4B:
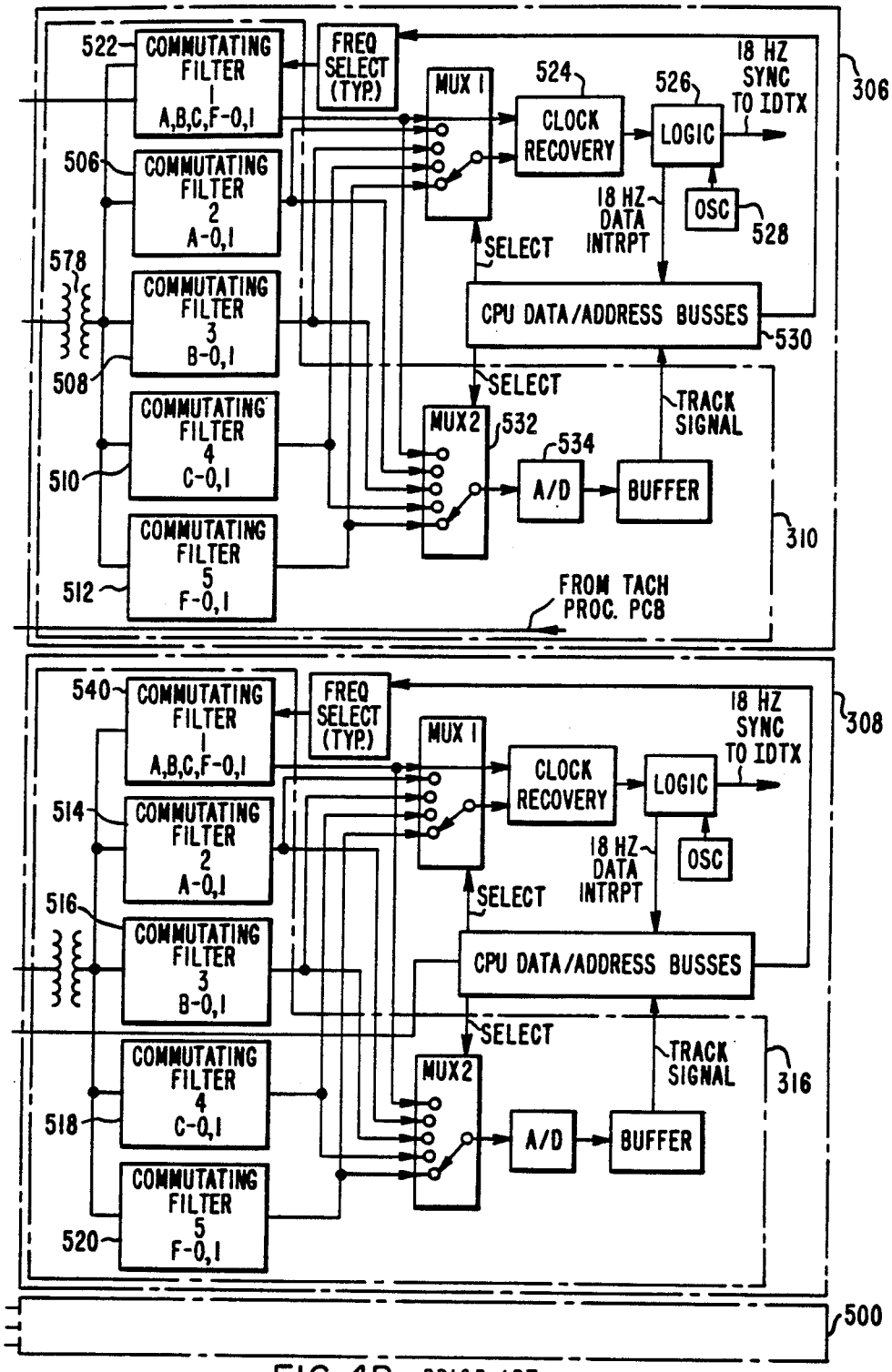
FIG. 4B PRIOR ART

In FIGS. 4A and 4B there is shown, as disclosed in the above-referenced patent application Ser. No. 609,253, a prior art speed decoding apparatus including the track signal antennas 300 and 302, the isolation transformer and filter and preamplifier 304, the hardware gain and code filter circuit 310 of the local microprocessor channel 306, and the hardware gain and code filter circuit 316 of the remote microprocessor channel 308. A third microprocessor channel 500 is provided as a second local channel in the event that the first local channel 306 should become not satisfactorily operative. The channel 306 can operate as the local channel and the remote channel can be either of the channels 308 and 500, or the channel 500 can operate as the local channel and the remote channel can be either of the channels 306 and 308. Each of the decoder microprocessor channels 306, 308 and 500 includes four fixed frequency filters that are tuned to either the ONES or ZEROS of the respective frequency pairs. For example, if the channel 306 is the local channel, the filter 506 can be tuned to the ONES frequency of the A frequency pair, the filter 508 can be tuned to the ONES frequency of the B frequency pair, the filter 510 can be tuned to the ONES frequency of the C frequency pair and the filter 512 can be tuned to the ONES frequency of the F frequency pair. If the channel 308 is the remote channel, the filter 514 can be tuned to the ZEROS frequency of the B pair, the filter 516 can be tuned to the ZEROS frequency of the B pair, the filter 518 can be tuned to the ZEROS frequency of the C pair and the filter 520 can be tuned to the ZEROS frequency of the F pair. Thusly, all filters are tuned to the ZEROS frequencies in the receiver channel 308 and to the ONES frequencies in the other receiver channel 306. In addition, a fifth filter is added to each of the receiver channels 306, 308 and 500, which fifth filter is identical in design to the other four filters in each channel, and is under control of a microprocessor to be set to any of the eight frequencies and is tuned to the complementary frequency of the fixed filter in the same channel that is receiving the greatest signal strength. For example, if the four fixed filters 506, 508, 512 and 512 of local channel 306 are tuned to the ONES frequencies, then the fifth filter 522 will lock onto the ZEROS frequency of the pair A, B, C or F whose ONES frequency is detected as having the highest amplitude. Since the local and remote channel receivers have between them a fixed filter examining each of the eight frequencies, the decoder can immediately determine the frequency transmission of the next speed code bit. The speed code bits are transmitted at an 18 Hz rate, with bit separation provided by means of the phase modulation such that every 1/18th of a second, the phase of the speed code signal is shifted by 180°. This phase shift is recovered by the clock recovery 524, logic 526 and oscillator 528 to synchronize a local 18 Hz oscillator which generates an interrupt signal to the control microprocessor 530. When this interrupt occurs, the analog signal issued from each filter is sampled by the multiplexer 532, converted into a digital format by the A to D converter 534 and read by the computer 530. The level of each filter signal is then compared to a predetermined threshold which when exceeded indicates that a valid speed code signal bit is being received. The signal issued from the fifth filter 522 is read and compared to the signal received by the corresponding frequency pair fixed filter. The information from the four fixed filters 506, 508, 510, 512 is then used to tune the fifth filter 522 to the complementary frequency of the strongest valid signal. The speed command which results from the local channel 306 is compared with the speed command issued by the redundant remote channel receiver 308, and if both of these speed command signals agree, then speed control of the vehicle is permitted.

In the second remote channel receiver 308, the four fixed filters 514, 516, 518 and 520 as well as the fifth filter 540 are set in the opposite configuration of the first receiver 306. For example, if in the first receiver 306 the fixed filters 506, 508, 510 and 512 are tuned to the ONES frequency, then in the second receiver 308, the fixed filters 514, 516, 518 and 520 will be set to the ZEROS frequencies and the fifth filter 540 to the ONES frequency.

In order to improve system reliability and to reduce the probability of an unsafe failure, a test signal 542 of a known frequency and level can be injected into the speed code receiver 306 every time the receiver 306 is not required to process data from the wayside for the control of vehicle speed, such as when the vehicle including the receivers 306, 308 and 500 is not head end. This is established by the operator key switch 544, which the operator closes when the vehicle including the decoder receivers 306, 320 and 500 is a head end control car in a train of such cars, to position the relay contacts 546 and 548 in the upper position opposite to that shown in FIG. 4A. The left track signal antenna 300 and the right track signal antenna 302 provide sensed speed coded command signals through the bandpass filters and the isolation transformer box 564. The sensed track speed command signal, including one particular frequency pair, passes to the preamplifier 568. With the key switch 544 closed for a head end car having an operator, the local channel contact 548 will be up and the track signal will go through the clipper driver 574 and transformers 576 and 578 to the local receiver channel 306. The switch 546 will be up and the track signal will also go through the transformer 582 to the remote receiver channel 308.

Figure 5A:
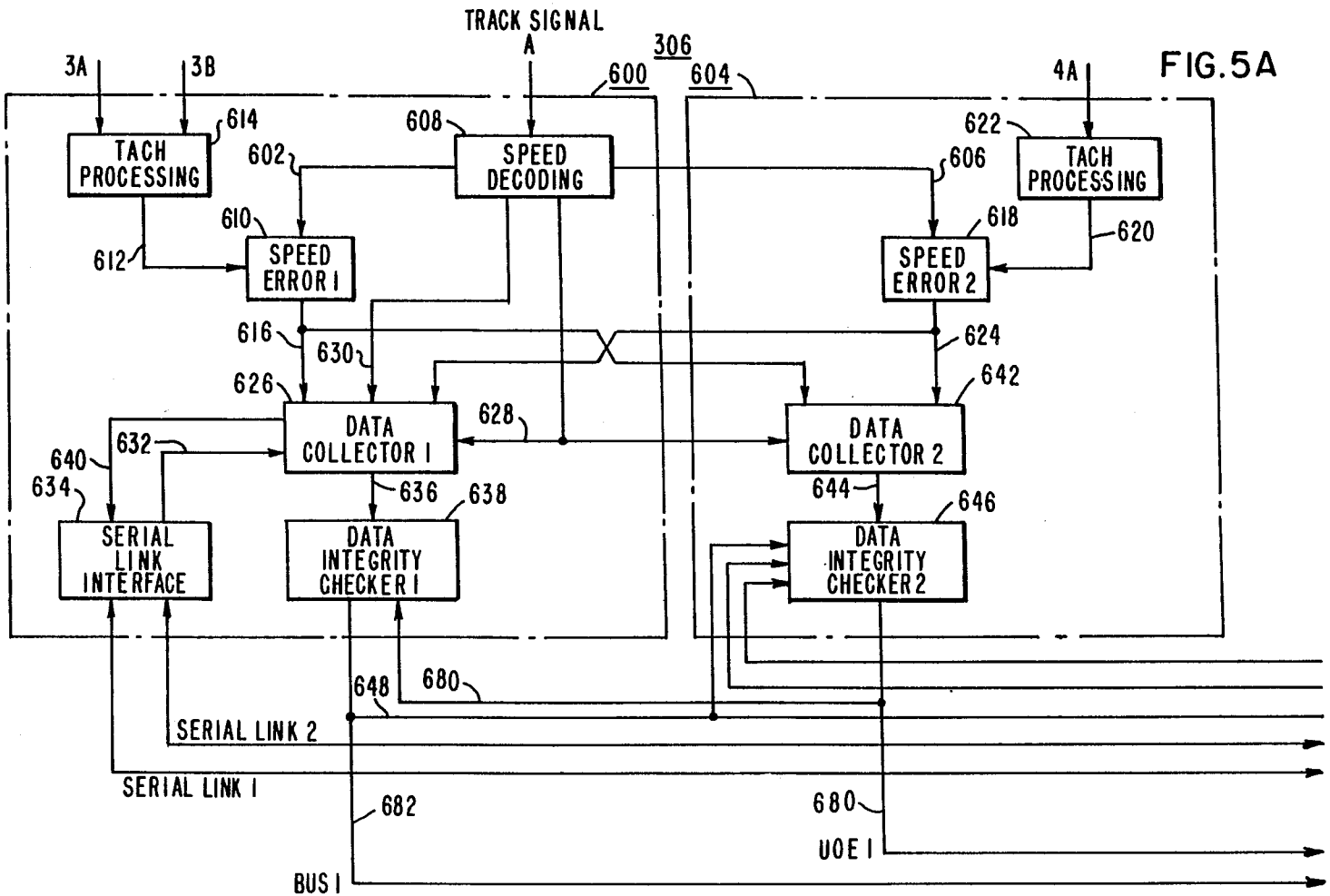
FIGS. 5A-5C show a schematic block diagram to illustrate the sequential operations of the speed control apparatus of the present invention.
Figure 5B:
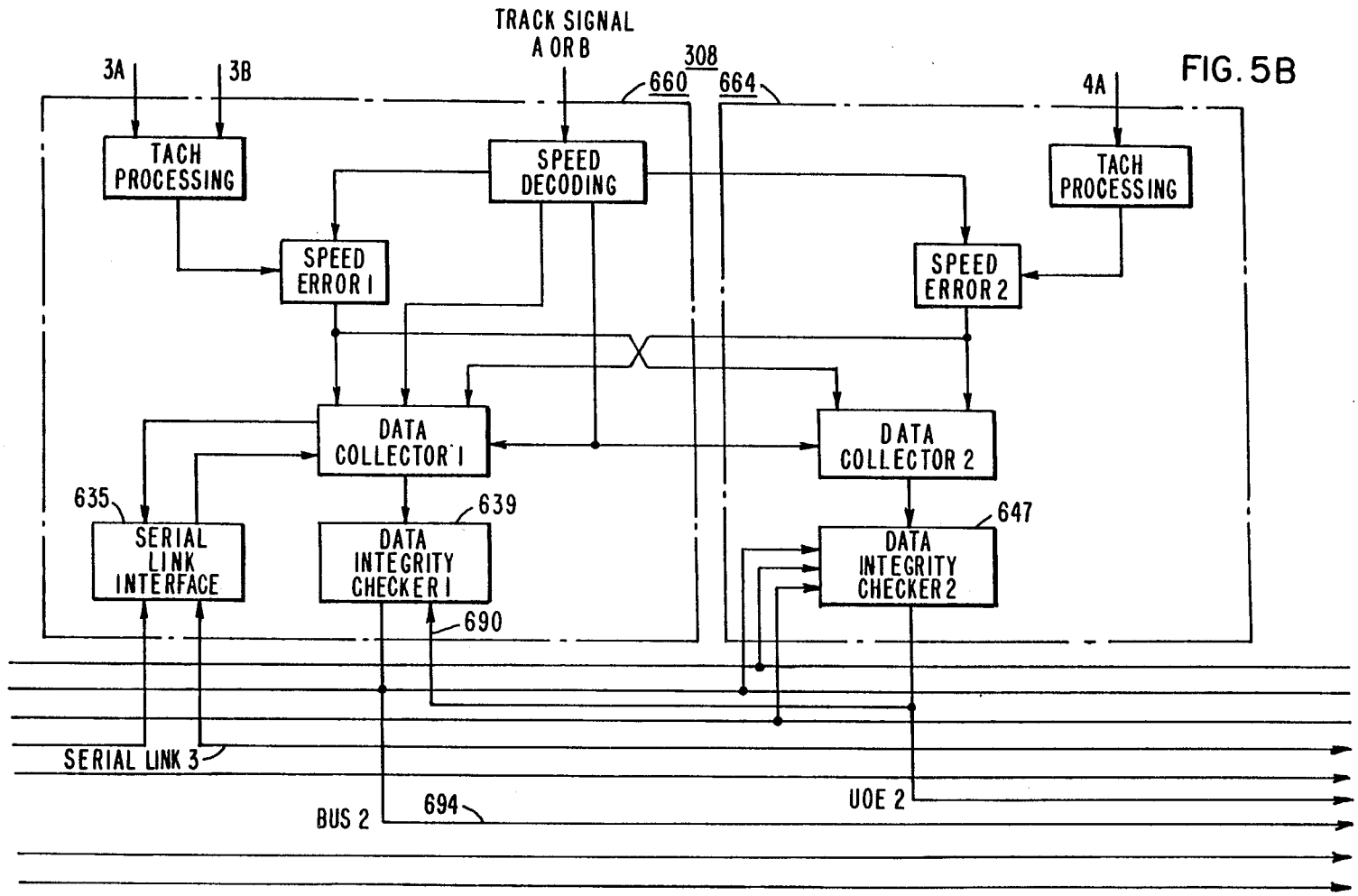
Figure 5C:
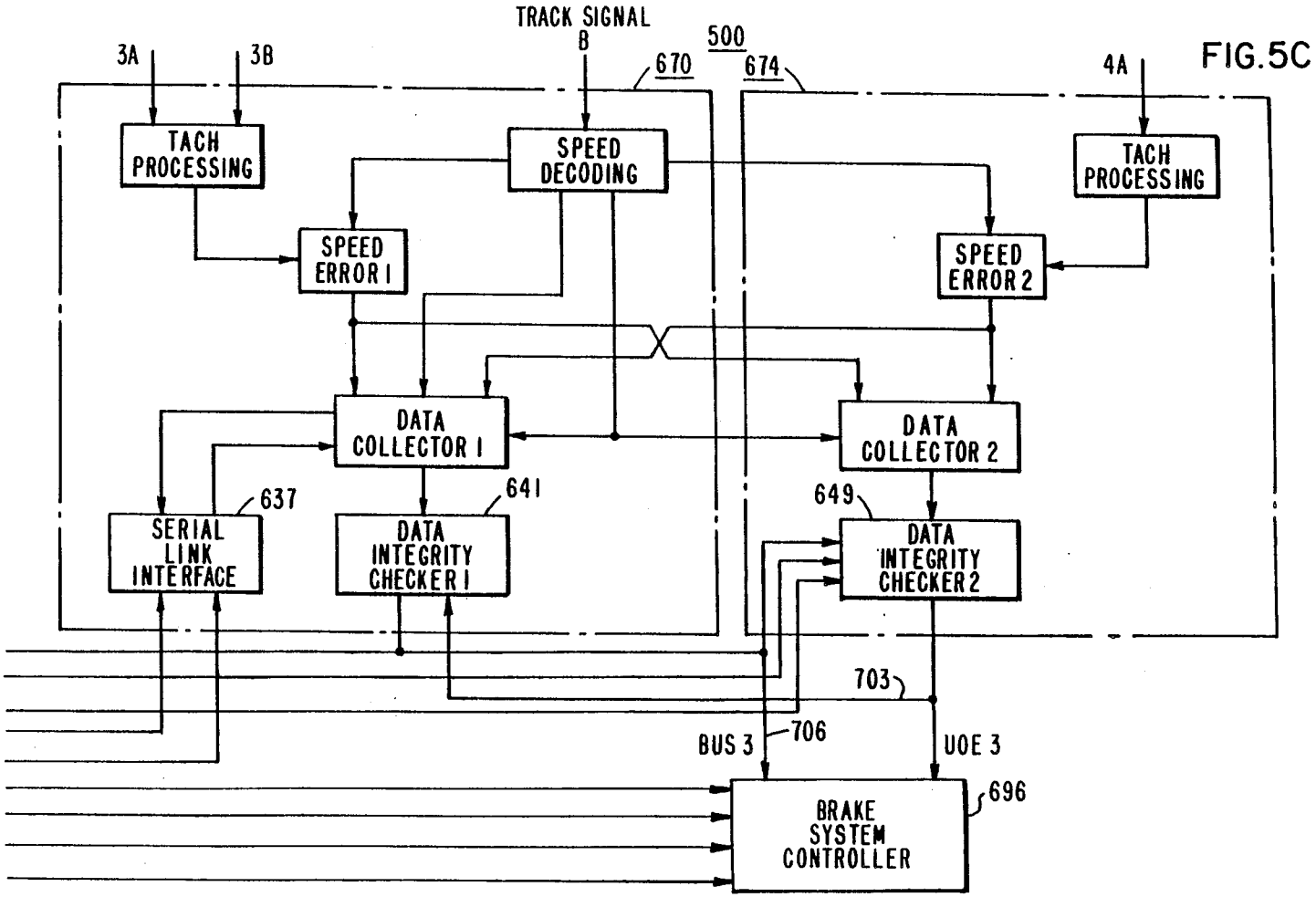

In FIG. 5, there is schematically shown the speed control apparatus of the present invention. The apparatus includes three microprocessor cradles 306, 308 and 500 and each cradle has two channels. The cradle 306 includes a first channel 600 and a second channel 604. The second cradle 308 includes first channel 660 and second channel 664. The third cradle 500 includes first channel 670 and second channel 674.

The speed decoding operation is done by the first channel 600 for the cradle 306, the speed decoding operation is done by the first channel 660 for the cradle 308 and the speed decoding operation for the third cradle 500 is done by the first channel 670. The data collector for each channel, such as the data collector 626 for channel 600 collects data, and the data integrity checker for each channel, such as the data integrity checker 638 for channel 600, makes predetermined comparisons of this data. The train operator selects whether two or three of the cradles 306, 308 and 500 are operative. The selected leader cradle, such as cradle 306, supplies the P and brake signal to control the vehicle. For running the vehicle, or train of vehicles, the tractive effort request must be generated and the leader cradle controls this operation. The first microprocessor cradle 306 is provided with a first channel 600 operative with the input signal SEROs speed command 602 and a second channel 604 operative with the input signal ONEs speed command 606. A speed decoder 608 provides each of the ZEROs speed command 602 and the ONEs speed command 606. The speed error determining apparatus 610 compares the ZERO speed command 602 with the vehicle speed 612 from the tachometer processing apparatus 614, which runs at an 18 Hz rate, to provide a ZEROs speed error signal 616. The second channel 604 includes a speed error determining apparatus 618, which compares the ONEs speed command 606 with the vehicle speed 620 from a tachometer processing apparatus 622, that runs at a 27 Hz rate, to provide a ONEs speed error signal 624. The data collector 626 of channel 600 receives the speed command 628 and the track signal level 630 from the decoder 608, the ZEROs speed error 616, the ONEs speed error 624 and the remote data 632 from the USART serial link 634 in relation to similar data from the operative remote cradles 308 and 500. The local data 640 from the data collector 626 is transferred to serial link interface 634 and from there to the two remote cradles 308 and 500 by means of two dedicated serial link interfaces 635 and 637.

From the data collector 626 both the remote and local data 636 is transferred to the data integrity checker 638. In the data integrity checker 638 the integrity of the data from the two local channels 600 and 604 is first checked. If the result of this comparison is they are substantially the same and that the speed error signals 616 and 624 indicate underspeed operation of the vehicle, then the local underspeed is enabled with an internal flag. Finally, the local data from cradle 306 is checked against the remote information from cradle 308 and 500, and when integrity is satisfied between the local data and one of the two remotes a 9hz square wave signal 682 is output as the balance-underspeed 1 to the propulsion and brake controller 696 and to the local data integrity checker 646 and to the remote data integrity checker 692 and 704 of respective cradles 308 and 500.

The data collector 642 of channel 604 receives the speed command 628, the ZEROs speed error 616 and the ONEs speed error 624, which information is sent to the data integrity checker 646, through the data path 644. In this data integrity checker 646, the data from the two local channels 600 and 604 is compared and if essentially the same a memory flag for the enable signal 682 is set. In addition the integrity of critical data stored in the RAM memory and the integrity of the 9hz balance-underspeed toggle signals 682, 694 and 706 issued by the local channel 306 and the two remotes 300 and 500 is checked. Finally, if no discrepancy is found, the underspeed operation enable signal 680 is issued to the brake system controller 696.

The second cradle 308 and the third cradle 500 operate with the signal information similarly to the previously described operation of the first cradle 306.

Figure 6:
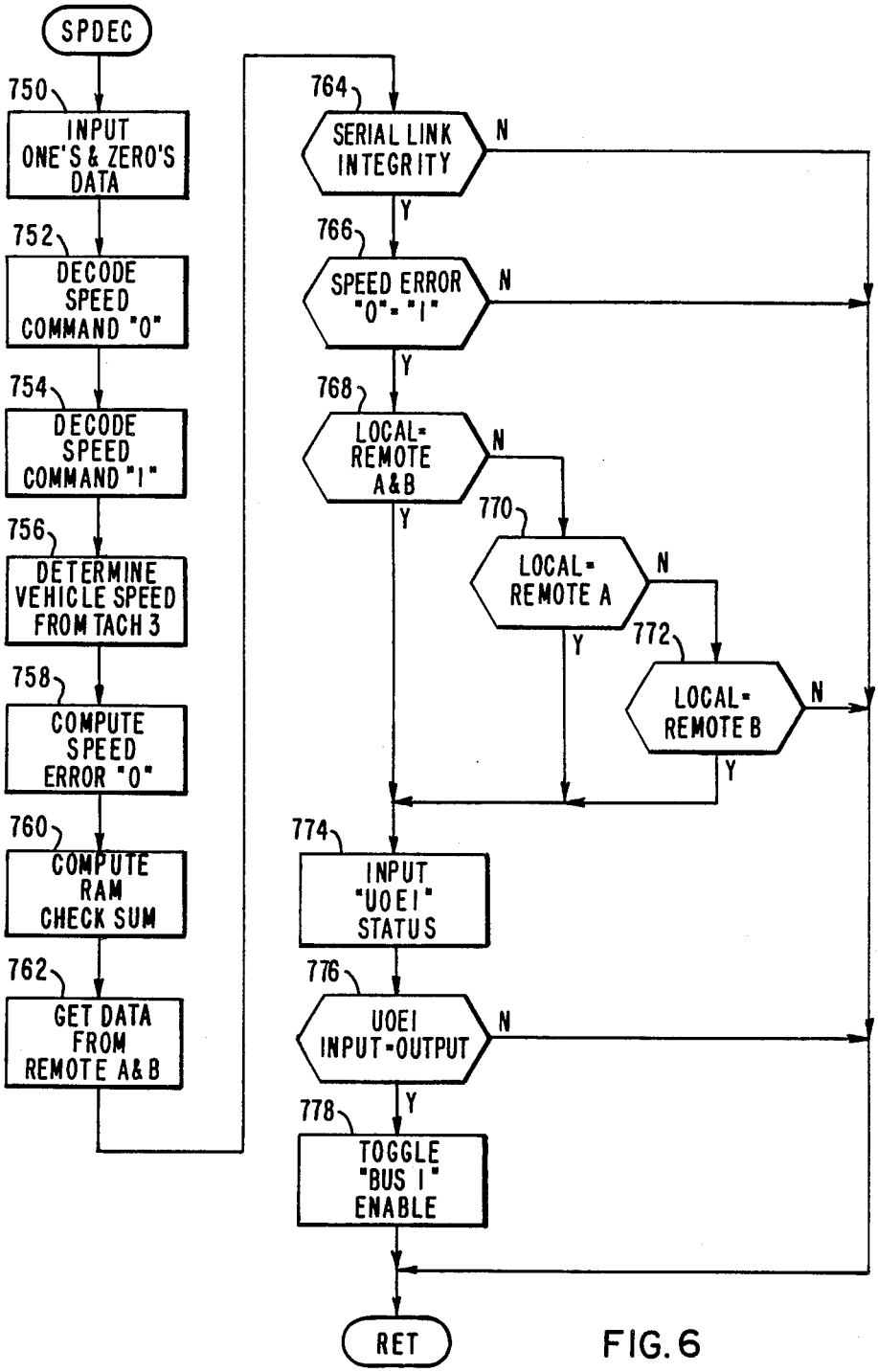
FIG. 6 shows a flow chart to illustrate the speed command signal receiving and decoding program of the present invention.
Figure 7:
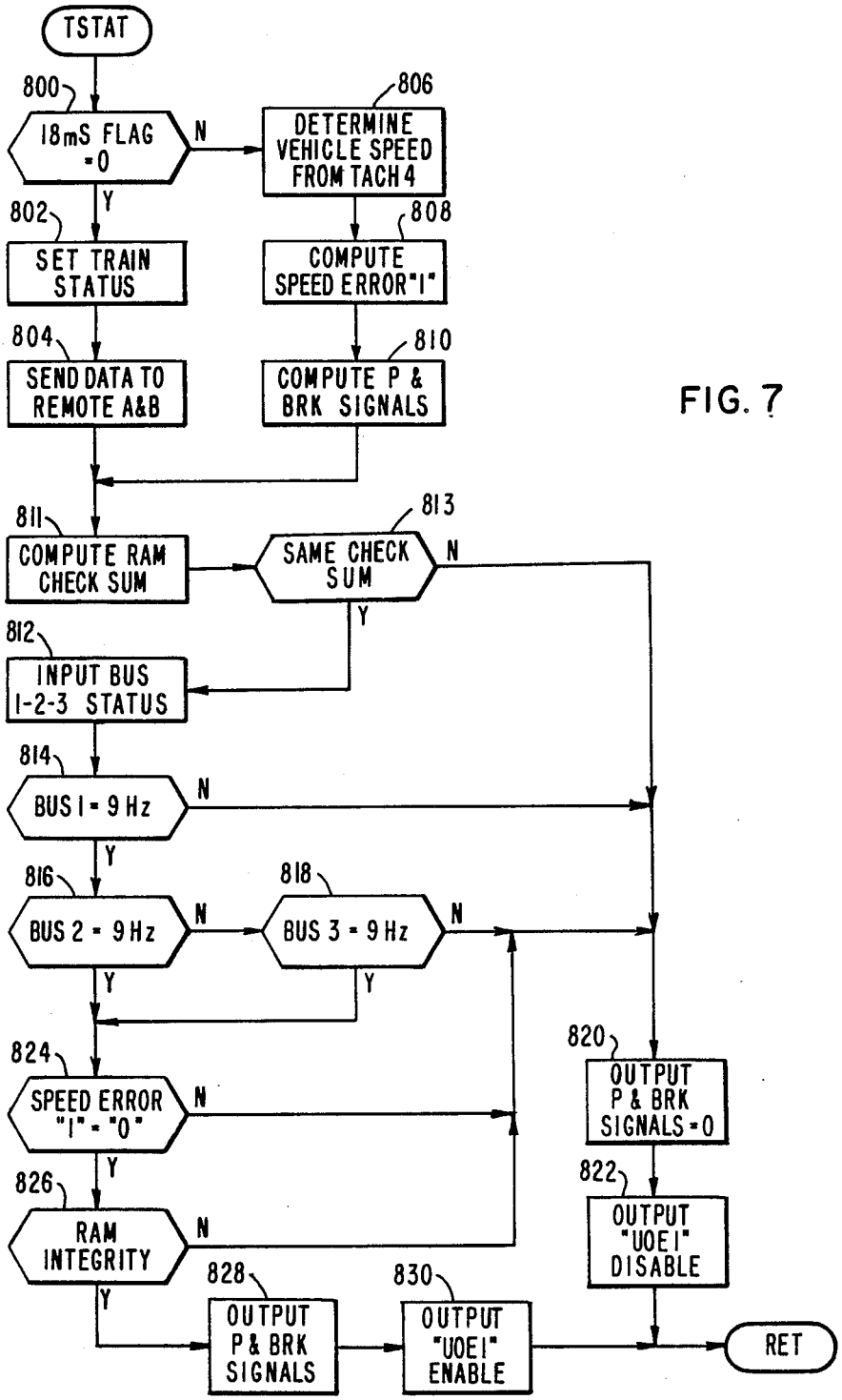
FIG. 7 shows a flow chart to illustrate the train status program of the present invention.

Each of the cradles 306, 308 and 500 is operative with the speed command signal receiving and decoding program functionally shown in FIG. 6 and the train status program functionally shown in FIG. 7. The train status relates to which car is heading the train, the mode of operation and how many cars in the train are cut out and not available for braking.

The leader cradle is determined with a select switch by the train operator and at least one of the other two cradles is selected to operate as the remote cradle. For example, cradle 306 can be selected by the operator to be the leader cradle and one of the cradles 308 and 500 could be selected to operate as the remote cradle. The leader cradle can shut down the brake controller 696 by removing either one of the balance 582 or the underspeed operation enable 680 upon the integrity operational failure of the local cradle 306 or the integrity operational failure of the selected remote cradle 308 or 500. The third cradle is provided for operational redundancy.

Each cradle has two channels operative for the same vehicle speed at different count frequencies. For example, cradle 306 has a first channel 600 operative with a 55 millisecond or 18 Hz, interrupt issued from the speed code clock recovery circuitry and a second channel 604 operative with a 18 millisecond or 55 Hz. interrupt issued from a real time clock circuit.

In FIG. 6, the speed decoding program for the first channel 600 operates with a 55 millisecond interrupt. At block 750, the ONEs and ZEROs input data is received from the fixed filter and the hunter filter of the channel. In block 752 the ZERO speed command data is decoded. In block 754, the ONEs speed command data is decoded. In block 756, the vehicle speed is determined from tachometer processing 614 which includes two tachometer signals 613 and 615 that are 90° out of phase, such as disclosed in U.S. Pat. No. 3,783,339 of T. C. Matty. In block 758, the speed error is computed in relation to the ZEROs speed command data 602. At block 760, a RAM memory check sum is generated to determine the integrity of the RAM memory, which is done for every 55 millisecond interrupt on all data which can be changed during that interrupt and is pertinent to this speed decoding routine. At block 762, the data is obtained from whichever of the two remote cradles 308 and 500 is operating, which data from the remote channel is provided by the serial link interface 634. At block 764, a check is made to see if the serial link has integrity as determined by the framing, overrun and parity bits. If not, the routine operation stops. If yes, at block 766, a check is made to see if the ZEROs speed error of channel 600 is the same as the ONEs speed error of channel 604 and if not the routine stops. If yes, at block 768, a check is made to see if the local channel data for track signal level threshold, acceleration cutout car, train status and speed command corresponds between both of the local cradle 306 and the selected remote cradle 308 and/or 500. To determine if only one remote cradle is operating, at block 770 a check is made to see if the above information of local cradle 306 corresponds with that of remote cradle 308. If not, then at block 772 a check is made to see if the operation of local cradle 306 corresponds with that of the other remote cradle 500. If not, the routine stops. If any of blocks 768, 770 and 772 is yes, then at block 774, the status of the underspeed operation enable 1 at output 680 of the data integrity checker 646 is input such that at block 776, a check can be made by the channel 600 of the integrity of the underspeed operation enable 680 generated by the other channel 604. If this check is not satisfactory, the routine stops. If yes, then at block 778, the output 9 Hz. square wave toggle signal 682 is provided.

In FIG. 7, the train status and speed control routine is shown that is operative with a second channel 604 of the cradle 306, and which operates with a time clock of 18 milliseconds or 55 Hz. for speed control. This 18 millisecond interrupt increments an eight bit counter up to 255 and then it rolls over and starts again at 0, to provide a flag that is odd and then even and then odd and so forth depending upon the present status of the counter. In block 800, a check of the least significant bit flag of the interrupt counter is made to see which of the train status or speed control routines will operate. When this flag is zero or even, the train status operation is run and when the flag is one or odd, the speed control operation is run. If the flag is zero, at block 802, the status of the tachometer integrity, the head-and car, the start-up signal, the door control, the automatic or manual mode of operation, is set as the train status. In block 804, this data with the speed command, speed error, track signal level and message check sum is sent to the remote cradles 308 and 500. If the flag is odd at block 800, then at block 806, the vehicle speed is determined by the tachometer processing apparatus 622. At block 808, the speed error is determined as the difference between the vehicle speed 620 and the input speed command 606, with the sign of the speed error setting an overspeed or underspeed flag. In block 810, the speed control is performed by means of the PI controller. This controller issues a tractive effort request signal and power/brake request signal according to the determined speed error. In block 811 a check sum is performed on the critical data which were saved in memory during the speed decoding routine. In block 813 this check sum is compared to ones generated at block 760. If a match occurs the program proceeds with block 812 otherwise the program goes to block 820. In block 812, the status of each of bus 1 shown as 682, bus 2 shown as 694 and bus 3 shown as 706 is input. At block 814, a check is made to see if bus 1 enable signal 682 for local channel 600 is equal to 9 Hz. to establish the integrity of this enable signal. At block 816, a check is made to see if bus 2 enable signal 694 for remote channel 660 is equal to 9 Hz. and if not at block 818, a check is made to see if bus 3 enable signal 706 for remote channel 670 is equal to 9 Hz. The train status interrupt runs at 55 Hz. which is about six times faster than the 9 Hz. enabel on the busses 1, 2 or 3, such that the bus data is sampled three times for each change of the 9 Hz. enable. If the local channel 306 does not have integrity at block 814, then at block 820 the P and brake signals are set to zero and at block 822, the underspeed operation enable 680 is disabled. If the integrity checks at block 814 and one of blocks 816 or 818 are satisfied, then at block 824, a check is made to see if the speed error for channel 600 is the same as the speed error for channel 604, which is a cross-check between the data collector 638 and the data collector 646. If these are essentially the same, such as within about one-half KPH since the timing of the two routines is different, there is considered to be satisfactory integrity. At block 826, an integrity check is made of the RAM memory by computing the check sum of the critical data and comparing it to the one issued by channel 604. If that is satisfied, at block 828, the tractive effort request and the power/brake signals are output to the controller 696. At block 830, the underspeed operation enable 680 is provided and then a return is made from the interrupt.

Each of the cradles 308 and 500 operate similarly with the speed decoding routine and train status routine shown in FIGS. 6 and 7.

Figure 8:
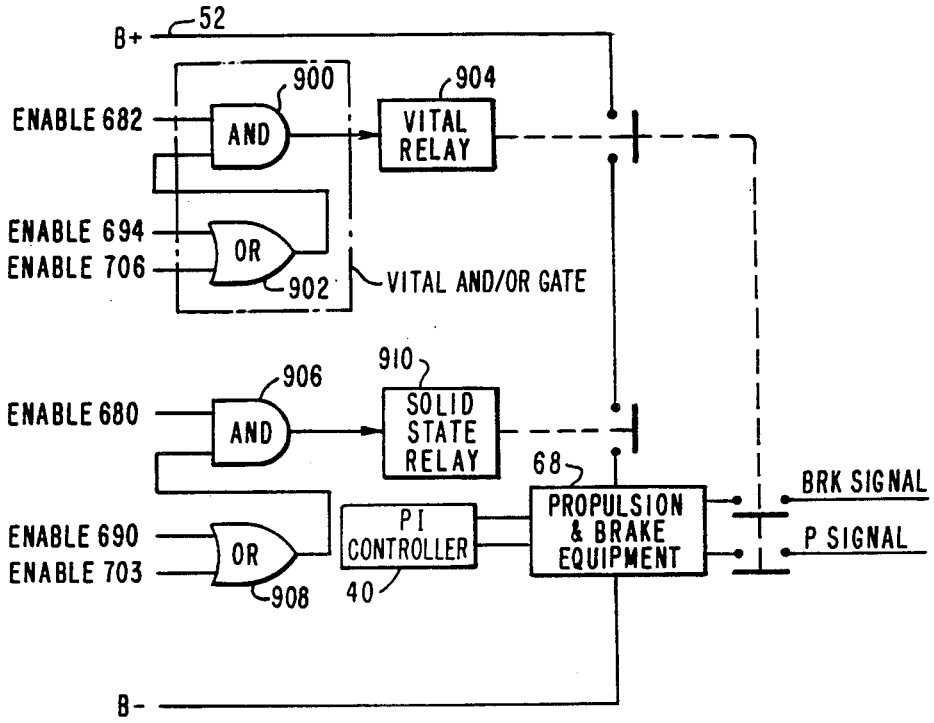
FIG. 8 shows a suitable application of the present invention for the control of a train vehicle.

In FIG. 8 there is shown a suitable application of the provided balance and underspeed enable signals 682, 694 and 706 to control the brake operation of the propulsion and brake equipment 68 shown in FIG. 2. In addition the underspeed operation enable signals 680, 690 and 703 can be applied to control the B+ energization of the P signal or tractive effort request signal generator within the P.I. controller 40 shown in FIG. 2. The enable signal 692, assuming the operator has selected cradle 306 to be the leader, operates with AND gate 900 in conjunction with either one of the enable signals 694 and 706 from the remote cradles 308 and 500 through the OR gate 902 to operate the vital relay 904 for removing the output signal 52 from the power and brake controller 54, such that a zero value signal is applied to the propulsion and brake equipment 68, when a satisfactory data operation is not determined by the data integrity checker 638 and one of the data integrity checkers 639 and 641. The enable signal 680, assuming the operator has selected cradle 306 to be the leader, operates with AND gate 906 in conjunction with either one of the enable signals 690 and 703 from the remote cradles 308 and 500 through the OR gate 908 to operate the relay 910 for removing the B+voltage energization from the P signal generator within the P.I. controller 40 when a satisfactory data operation is not determined by the data integrity checker 646 and one of the data integrity checkers 647 and 649.

In automatic train control, system safety is of vital importance. In the operation of the present invention, safety is achieved through the use of redundancy associated to vital circuits. One of the main issues is to insure the integrity of each independent channel and to take an action if a discrepancy occurs, this is done by two cross-coupled data integrity checkers.

In order to improve safety and availability three independent microprocessor based cradles 306, 308 and 500 are used. Each cradle computes first its own or local data and then sends it to the other two cradles through a dedicated serial link. At the receiving end, the incoming data or remote data is down loaded from the serial link and compared to the local one in the software implemented dated integrity checker. The output of this checker is a 9hz signal which serves as an enable for the brake controller. This signal is also fed back into each cradle for integrity cross check which is done by the second local channel. The purpose of this second channel is essentially to insure the integrity of the two local independent speed errors and the balance integrity between the local and the remote channels.

The balance detectors are implemented by a software program running under the control of two real time generated interrupts. In the first routine shown in FIG. 6 which is controlled by the 18hz speed decoding routine, the local data is compared to the one of the two remote channels. A 9hz toggle signal is output to the brake controlling circuitry if the result of the comparison between the local and one or both of the remote channels indicates balance and integrity.

In the second routine shown in FIG. 7, which runs off the 55.56hz interrupt service routine, the integrity of the local and of the two remote balance and underspeed signals is checked. In other words, every 18ms each of the three balance/underspeed signals is sampled through an I/O port and their integrity checked. This consists of verifying that in 108ms each signal appears in average three times at logic level "1" and three times at logic level "0". In addition, the two independent local speed errors are compared and checked for their integrity. If no discrepancy has occurred between the two local channels and if two of the three balance/underspeed signals are dynamic and of a 9hz frequency then an enable signal is output to the brake control system to indicate that underspeed operation is allowed.

What is claimed:

1. In apparatus for controlling a vehicle having a propulsion and brake controller and moving along a track providing to the vehicle an input speed command, the combination of:

first means responsive to the vehicle movement for providing a first vehicle speed signal;

second means responsive to the vehicle movement for providing a second vehicle speed signal;

first speed channel control means having a first channel responsive to the input speed command and responsive to the first vehicle speed signal to provide a first speed error and having a second channel responsive to the input speed command and the second vehicle speed signal to provide a second speed error;

at least second speed channel control means having a third channel responsive to the input speed command and responsive to the first vehicle speed signal to provide a third speed error and having a fourth channel responsive to the input speed command and responsive to the second vehicle speed signal to provide a fourth speed error;

said first speed channel control means including comparator means for comparing the first, second, third and fourth speed errors to provide a first output signal to enable the operation of the propulsion and brake controller when there is substantial equality among said speed errors;

said first speed channel control means further having means for making a first integrity check of said first and second speed channel control means and permitting the first output enable signal to operate the controller when the first integrity check is satisfactory;

said second speed channel control means including another comparator means for comparing the first, second, third and fourth speed errors to provide a second output signal to enable the operation of the propulsion and brake controller when there is substantial equality among said speed errors; and said second speed channel control means further having means for making a second integrity check of said first and second speed channel control means and permitting the second output enable signal to operate the controller when the second integrity check is satisfactory.

2. The apparatus of claim 1, with the first control means including fifth means for comparing the first output signal and the second output signal to provide a third output signal to enable the operation of the propulsion and brake controller, and with the second control means including sixth means for comparing the first output signal and the second output signal to enable the operation of the propulsion and brake controller.

3. The apparatus of claim 1 wherein said first and second output signals are each a toggle signal having a first frequency, and said first and second integrity checking means each includes means for sampling the logic level of said first and second output signals at a second higher frequency thereby determining the validity of said output signals and in turn the integrity of said speed channel control means.

4. An apparatus for controlling a propulsion motor of a vehicle moving along a track providing to the vehicle an input speed command having first and second information components, the combination of:

first means responsive to the vehicle movement for providing a first vehicle speed signal;

second means responsive to the vehicle movement for providing a second vehicle speed signal;

first speed channel control means having a first channel responsive to the first and second information components of the input speed command and responsive to the first vehicle speed signal to provide a first speed error and having a second channel responsive to one of the first and second information components of the input speed command and the second vehicle speed signal to provide a second speed error;

at least second speed channel control means having a third channel responsive to the first and second information components of the input speed command and responsive to the first vehicle speed signal to provide a third speed error and having a fourth channel responsive to one of the first and second information components of the input speed command and responsive to the second vehicle speed signal to provide a fourth speed error;

said first speed channel control means including comparator means for comparing at least two of the first, second, third and fourth speed errors to provide a first output signal to enable the operation of said motor when there is substantial equality between the compared speed errors;

said first speed channel control means further having means for making a first integrity check of said first and second speed channel control means and permitting said first output enable signal to operate the motor;

said second speed channel control means including another comparator means for comparing at least two of the first, second, third and fourth speed errors to provide a second output signal to enable the operation of said motor when there is substantial equality between the compared speed errors; and said second speed channel means further having means for making a second integrity check of said first and second speed channel control means and permitting said second output enable signal to operate the motor.

* * * * *